United States Patent [19]

Liebermann

[11] Patent Number: 4,834,815

[45] Date of Patent: May 30, 1989

[54] IRON-BASED AMORPHOUS ALLOYS CONTAINING COBALT

[75] Inventor: Howard H. Liebermann, Succasunna, N.J.

[73] Assignee: Allied-Signal Inc., Morris Township, Morris County, N.J.

[21] Appl. No.: 109,554

[22] Filed: Oct. 15, 1987

[51] Int. Cl.[4] ..... C22C 38/10; C22C 38/02

[52] U.S. Cl. ..... 148/304; 420/121

[58] Field of Search ..... 148/304, 403; 420/121

[56] References Cited

U.S. PATENT DOCUMENTS 4,226,619 10/1980 Hatta et al. ..... 148/304

FOREIGN PATENT DOCUMENTS 61-83454 8/1986 Japan ..... 148/304

*Primary Examiner*—Deborah Yee

*Attorney, Agent, or Firm*—Gus T. Hampilos

[57] ABSTRACT

Metallic alloys are disclosed which are at least about 90% amorphous, having enhanced magnetic properties and consist essentially of a composition represented by the formula $Fe_{a-b}Co_bB_cSi_dC_e$, wherein "a", "b", "c", "d" and "e" are atomic percentages ranging from about 75 to about 85, about 0.1 to about 0.8, about 12 to about 15, about 2 to about 5 and about 1 to about 3, respectively. Magnetic cores comprising such alloys, including cores having been subjected to a field anneal, are also disclosed.

14 Claims, 7 Drawing Sheets

IRON-BASED AMORPHOUS ALLOYS CONTAINING COBALT

DESCRIPTION

1. Field of the Invention

The invention is directed to iron-based amorphous metallic alloys containing cobalt and, more particularly, to iron-based amorphous metallic alloys containing cobalt, boron, silicon and carbon having enhanced saturation induction, lower core loss and lower exciting power as compared to prior art alloys.

BACKGROUND OF THE INVENTION

Amorphous materials substantially lack any long range atomic order and are characterized by X-ray diffraction patterns consisting of diffuse (broad) intensity maxima, quantitatively similar to the diffraction patterns observed for liquids or inorganic oxide glasses. Such patterns are in stark contrast to those observed with crystalline materials: diffraction patterns which consist of sharp, narrow intensity maxima.

Amorphous materials exist in a metastable state. Thus, upon heating to a sufficiently high temperature, they begin to crystallize with evolution of the heat of crystallization; the X-ray diffraction pattern thereby begins to change from that observed for amorphous materials to that observed for crystalline materials.

The most well-known disclosure directed to amorphous metallic alloys is U.S. Pat. No. 3,856,513 to H. S. Chen and D. E. Polk. Disclosed therein is a class of amorphous metallic alloys having the formula $M_aY_bZ_c$, where M is at least one metal selected from the group of iron, nickel, cobalt, chromium and vanadium, Y is at least one element selected from the group consisting of phosphorus, boron and carbon, Z is at least one element selected from the group consisting of aluminum, antimony, beryllium, germanium, indium, tin and silicon, "a" ranges from about 60 to 90 atom percent, "b" ranges from about 10 to 30 atom percent and "c" ranges from about 0.1 to 15 atom percent.

With continuing research and development in the area of amorphous metallic alloys, it has become apparent that certain alloy systems possess magnetic and physical properties which enhance their utility in certain applications, particularly in electrical applications as core materials for transformers, generators and electric motors. One such alloy which, early on, was identified as exhibiting such properties is $Fe_{80}B_{20}$.

It is known, however, that $Fe_{80}B_{20}$ is difficult to cast in the amorphous form and tends to be thermally unstable. Thus, alloys of greater stability and castability had to be developed to allow the practical use of amorphous metal alloys in the manufacture of electromagnetic cores, especially cores for transformers. One such class of alloys is disclosed in U.S. Pat. No. 4,219,355.

The alloys disclosed in U.S. Pat. No. 4,219,355 are represented by the formula $Fe_aB_bSi_cC_d$ wherein "a", "b", "c" and "d" are in atomic percentages and range from about 80 to about 82, about 12.5 to about 14.5, about 2.5 to about 5, and about 1.5 to about 2.5, respectively. These alloys exhibit improved AC and DC magnetic properties that remain stable at temperatures up to about 150° C. As a result, these alloys are particularly suitable for use in power transformers, aircraft transformers, current transformers, 400 Hz transformers, magnetic switch cores, high gain magnetic amplifiers and low frequency inverters.

Other classes of alloys have been identified as being suitable for use in the manufacture of transformers. For example, U.S. Pat. Nos. 4,217,135 and 4,300,950 are directed to certain iron-boron-silicon alloys which are disclosed as being useful in the manufacture of transformer cores.

As is readily apparent from the disclosures in the above referenced patents, it is well-recognized that differences in chemical compositions need not be great in order to achieve dramatic effects on the castability of amorphous metallic alloys, the resultant magnetic and mechanical properties, and the thermal stablitiy of these properties. For transformer core materials in particular, ease of castability, high saturation magnetization, low core loss, low exciting power, ductility and high thermal stability are the most desirable properties.

Although substantial progress has been made in identifying alloys which more closely meet the needs of transformer core manufacturing industry, additional developments toward yet even higher saturation induction, lower core loss, lower exciting power and better thermal stability at elevated operating temperatures are necessary.

BRIEF DESCRIPTION OF THE INVENTION

The present invention is directed to novel metallic alloys which consist essentially of a composition represented by the formula $Fe_{a-b}Co_bB_cSi_dC_e$ wherein "a", "b", "c", "d" and "e" are in atomic percentages ranging from about 75 to about 85, about 0.1 to about 0.8, about 12 to about 15, about 2 to about 5, and about 1 to about 3, respectively. The alloys of the present invention are characterized by excellent castability and ductility.

The present invention is also directed to alloys of the above-noted composition which are at least about 90 to percent amorphous. Amorphous alloys of the present invention exhibit saturation magnetization values of at least about 1.5 tesla at 100° C. and core losses of less than about 0.2 watts per kilogram at 100° C. Moreover, amorphous alloys of the present invention preferably exhibit exciting power values of less than about 0.3 VA/kg at induction levels of about 1.5 tesla.

The present invention is also directed to improved magnetic cores comprising such amorphous alloys. The improved magnetic cores comprise a body of amorphous metallic alloy, said amorphous metallic alloy having a composition which includes iron, silicon, boron, carbon and cobalt, which body has been annealed in the presence of a magnetic field.

DETAILED DESCRIPTION OF THE INVENTION

Figure 1:
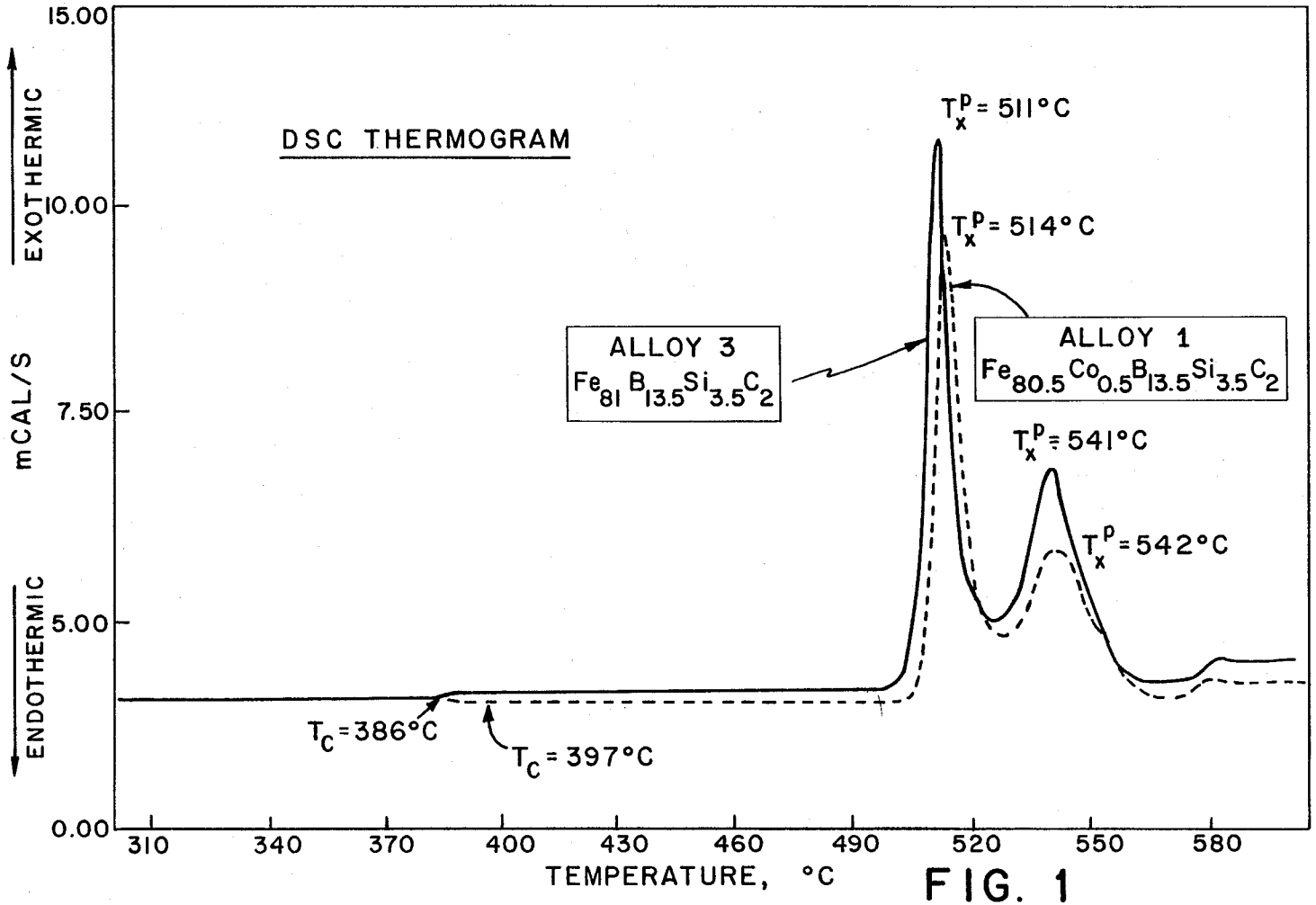
FIG. 1 is a comparative plot of Curie temperatures and first and second crystallization temperatures for a prior art alloy, $Fe_{81}B_{13.5}Si_{3.5}C_2$, and an alloy of the present invention, $Fe_{80.5}Co_{0.5}B_{13.5}Si_{3.5}C_2$.

The alloy composition of the present invention is represented by the formula:

$Fe_{a-b}Co_bB_cSi_dC_e$ plus incidental impurities, wherein "a", "b", "c", "d" and "e" are in atomic percentages and "a" is in the range of about 75 to about 85, "b" is in the range of about 0.1 to about 0.8, "c" is in the range of about 12 to about 15, "d" is in the range of about 2 to about 5 and "e" is in the range of about 1 to about 3. It should be understood that the total of a-e plus impurities equals 100.

The alloys of the present invention exhibit enhanced D.C. and A.C. magnetic properties as evidenced by high saturation magnetization values low A.C. core loss and low exciting power when in a form in which the alloy is at least about 90% amorphous, preferably at least about 95% amorphous and more preferably when substantially entirely amorphous.

Amorphous metallic alloys of the present invention are formed by cooling a melt of the alloy at a rate of at least about $10^5$K/seC. Typically, a particular composition is selected from powders or granules of the requisite elements (or materials which decompose to form the elements, such as ferroboron, ferrosilicon, etC.) in the desired proportions and is then melted and homogenized. The melt is then deposited onto a chill surface to form a variety of products such as splat quenched foils or continuous wire, strip, sheet, etC. Most preferably, the melt is rapidly quenched by depositing it onto a rapidly moving chill surface, such as a rotatable wheel as is disclosed, for example, in U.S. Pat. No. 4,221,257.

Amorphous alloys of the present invention result in an optimized combination of high saturation magnetization, low core loss and low exciting power. It should be readily apparent that a given individual property of each alloy may be less than the most preferred value. Nonetheless, the alloys of the present invention constitute the ideal balance among the requisite properties for the production of magnetic cores, especially those cores employed in the manufacture of transformers.

Amorphous alloys of the present invention preferably exhibit saturation magnetization values of at least about 1.5 tesla over a temperature range of about −40° C. to about +150° C. More preferably, they exhibit a saturation magnetization value of at least about 1.67 tesla at 20° C. and most preferably a value of at least about 1.55 tesla at 80° C. (ordinary operating temperature for amorphous alloy distribution transformers). Core losses attributable to such amorphous alloys do not exceed about 0.2 watts per kilogram over the same −40 ° C. +150° C. range at an induction of 1.3 tesla. More preferably, core losses are less than about 0.18 watts per kilogram at 80°-100° C. at a induction of 1.3 T, and more preferably exhibit core losses of not more than about 0.17 watts per kilogram at 100° C. and at an induction of 1.3 T. Moreover, amorphous alloys of the present invention exhibit an exciting power of less than about 0.3 volt-amperes per kilogram at induction levels as high as about 1.5 T, preferably less than about 0.25 VA/kg at such induction levels, and more preferably not more than about 0.20 VA/kg at 1.3 T.

The alloys of the present invention exhibit processability equivalent to that of the prior art alloys. In addition, amorphous alloys of the present inventions are more stable than certain preferred prior art alloys, as is demonstrated by the graph of FIG. 1. In pparticular, the Curie temperature of an amorphous alloy of the present invention, for which 0.5 atom percent Co has been substituted for Fe, is 11 K higher than that for an equivalent prior art alloy which does not contain cobalt.

The constituents of the alloys of the present invention contribute to the above-described properties. To maximize magnetic saturation values, the amount of iron should be as high as possible. While the iron content of the alloys of the present invention can range from about 75 atom percent to about 85 atom percent, it is most preferable to maintain the iron content at least at about 79 to achieve maximum saturation values. Boron is, of course, added to promote metallic glass formation. Silicon is added to increase the crystallization temperature and magnetic stability of the alloy. Carbon is added to facilitate processing of the alloy into its amorphous state. Thus, the boron, silicon, and carbon contents are maintained within the ranges of about 12 to about 15 about 2 to about 5, and about 1 to about 3, respectively.

In accordance with the present invention, it was discovered that the addition of cobalt as a substitute for iron unexpectedly enhances all of the properties affected by the above recited constituents. However, the cobalt addition must be carefully controlled to within the range of about 0.1 to about 0.8 atom percent, with cobalt present in the range of about 0.4 to about 0.6 atom percent being most preferable.

The properties of the amorphous alloys of the present invention are further enhanced by annealing the alloys. The method of annealing generally comprises heating the alloy to a temperature sufficient to achieve stress relief but less than that required to initiate crystallization, cooling the alloy, and applying a magnetic field to the alloy at least during the annealing cycle, and, most preferably, also during the cooling step. Generally, a temperature range of about 300° C. to about 400° C. is employed during heating, with temperatures of about 360° C. to about 370° C. being most preferred. A rate of cooling ranging from about 0.5° C./min. to about 75° C./min. is employed, with a rate of about 10° C./min. to about 15° C./min, being most preferred.

Figure 2:
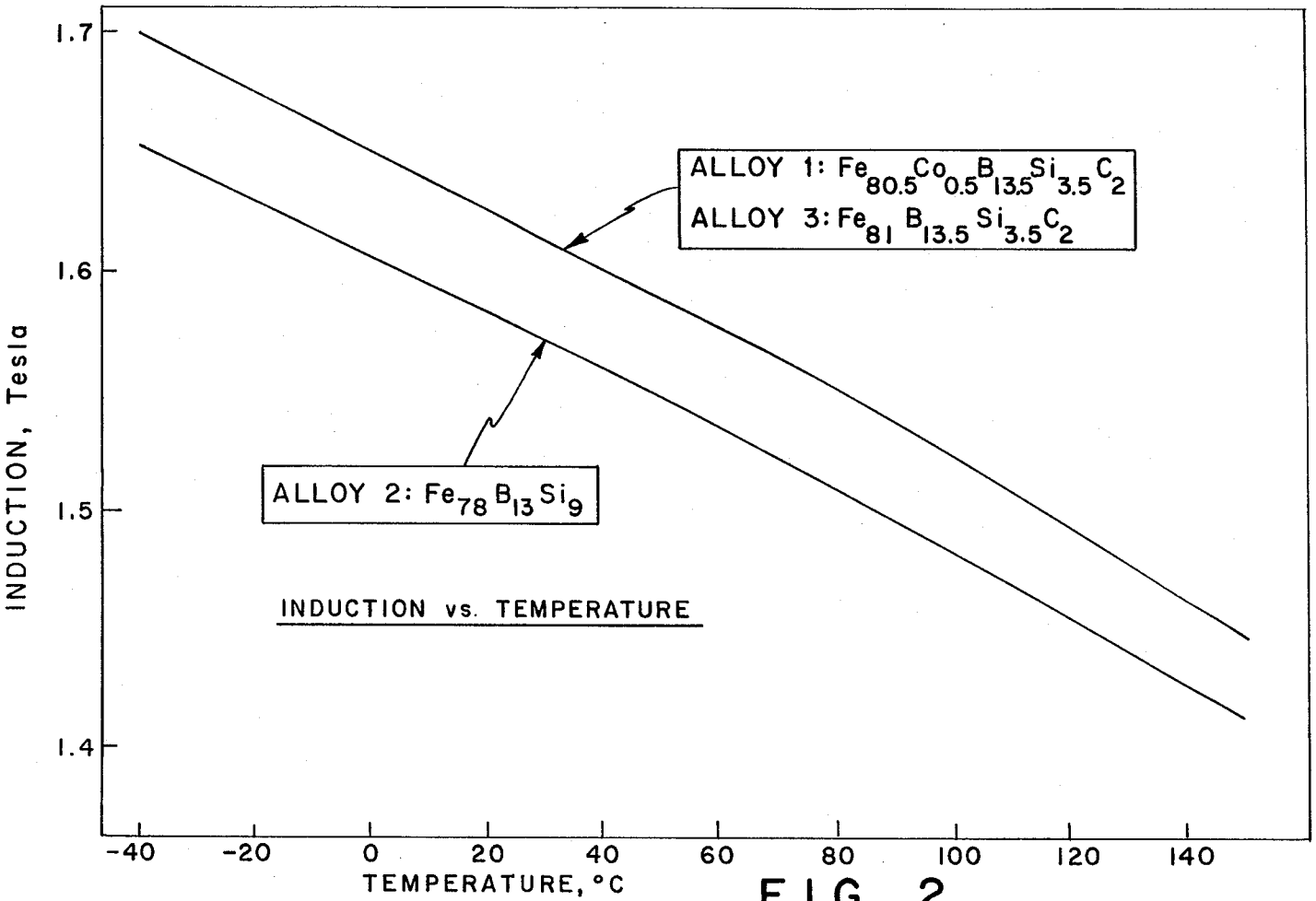
FIG. 2 is a graph illustrating saturation induction values as a function of temperature for each of two prior art alloys, $Fe_{81}B_{13.5}Si_{3.5}C_2$ and $Fe_{78}B_{13}Si_9$, and an alloy of the present invention, $Fe_{80.5}Co_{0.5}B_{13.5}Si_{3.5}C_2$.
Figure 4:
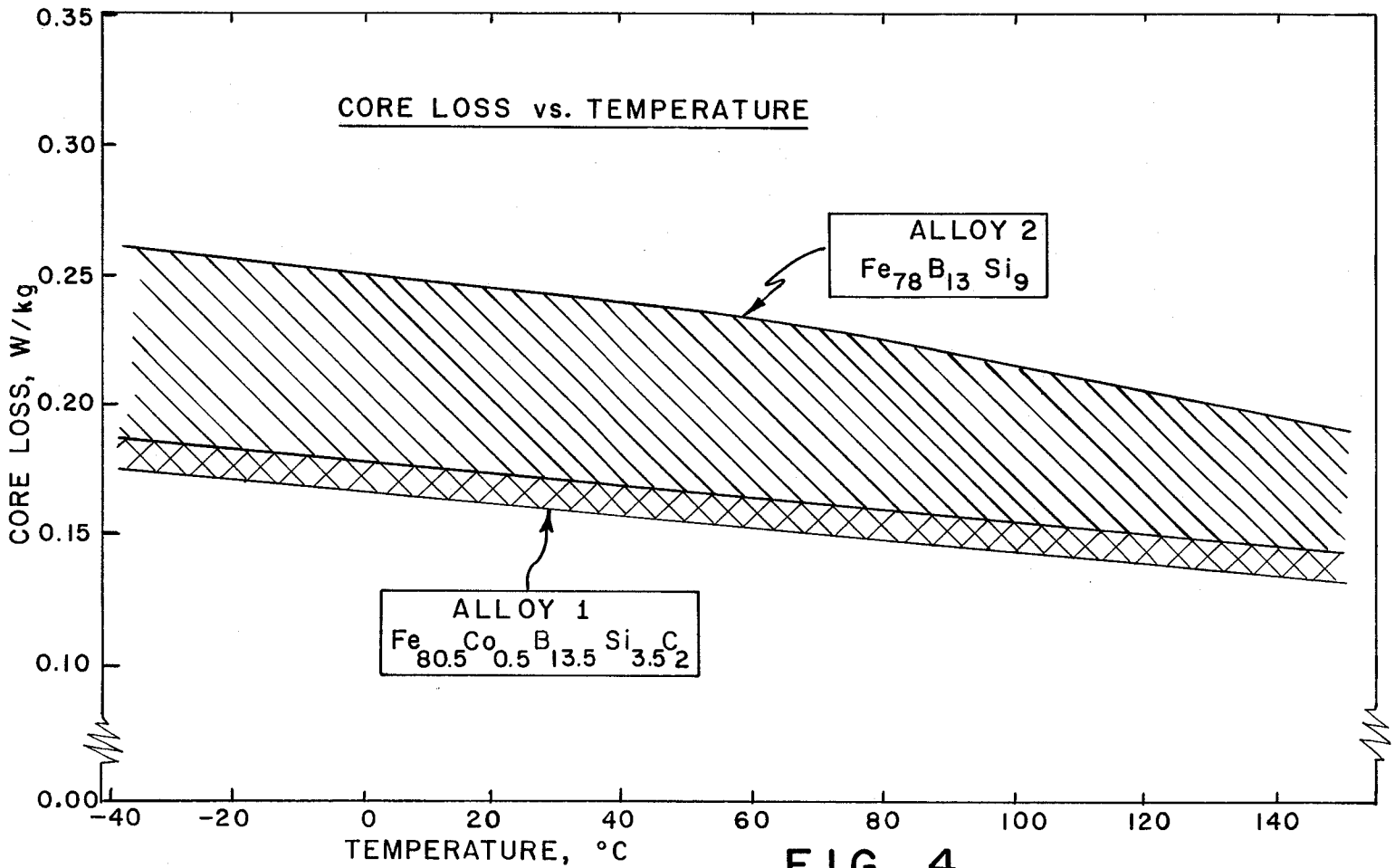
FIG. 4 illustrates the relative core loss at varying temperatures for a variety of samples of a prior art alloy, $Fe_{78}B_{13}Si_9$, and an alloy of the present invention, $Fe_{80.5}Co_{0.5}B_{13.5}Si_{3.5}C_2$.

As discussed above, the amorphous alloys of the present invention exhibit improved magnetic properties that are stable at ordinary operating temperatures of devices incorporating the materials (80° C.-120° C.) and, in fact, as is illustrated in FIGS. 2 and 4, are more than adequate at temperature of up to at least about 150° C. The high thermal stability makes the amorphous alloys of the present invention particularly suitable for application as core materials for transformers, especially distribution transformers. Specifically, the higher induction values, coupled with extraordinarily low core losses, allows for the operation of transformers at a higher capacity as compared to prior art transformers of equal core mass. Moreover, the low energy losses enable a reduction in the cooling capacity requirements and, therefore, a reduction in weight, which is especially significant for transformers used in aircraft applications. Further, the lower exciting power levels also contribute to increased efficiency of transformers formed from amorphous alloys of the present invention and correspondingly increased power savings.

The following examples are presented to illustrate the present invention. The specific techniques, condition, materials, proportions and reported data are set forth to illustrate the invention and should not be construed as limiting the scope of the invention defined by the subjoined claims.

EXAMPLE 1

A sample of a prior art amorphous alloy having the composition $Fe_{81}B_{13.5}Si_{3.5}C_2$ and a sample of a preferred alloy of the present invention, $Fe_{80.5}Co_{0.5}B_{13.5}Si_{3.5}C_2$, were subjected to DSC analysis (scan rate of 20° C./min.) to determine the Curie temperature and first and second crystallization temperatures of the materials. Both the prior art material and the preferred alloy of the present invention were prepared by the following process:

A shrink-fit, casting wheel having a beryllium copper substrate was used to prepare the iron-base amorphous metallic ribbons. The casting wheel had an internal cooling structure similar to that described in U.S. Pat. No. 4,537,239, a diameter of 38 cm and a width of 38 cm. It was rotated at a speed of 990 rpm, corresponding to a circumferential surface velocity of 20 m/s. The substrate was conditioned continuously during the run by an idling brush wheel inclined about 10° out of the casting direction. A nozzle having a slotted orifice of 0.4 millimeter width and 10 centimeter length defined by a first lip and a second lip each having a width of 1.5 millimeters (lips numbered in direction of rotation of the chill roll) was mounted perpendicular to the direction of movement of the peripheral surface of the casting wheel, such that the gap between the first and second lips and the surface of the casting wheel was 0.20 millimeter. Iron-based metallic alloy with a melting point of about 1100° C. was supplied to the nozzle from a pressurized crucible, the alloy within the crucible being maintained under pressure of about 2.9 psig (20 kPa) at temperature of 1300° C. Pressure was supplied by means of an argon blanket. The molten alloy was expelled through the slotted orifice at the rate of 22 kilograms per minute. It solidified on the surface of the chill roll into a strip of 0.026 millimeter thickness having width of 10.0 cm. Upon examination using X-ray diffractometry, the strip was found to be amorphous in structure.

As shown in FIG. 1, the addition of cobalt produces a dramatic increase in the Curie temperature and a significant increase in the first crystallization temperature, which properties are indicative of a more stable amorphous product.

EXAMPLE 2

Samples of the following alloys were tested over a range of temperatures to develop saturation induction curves therefor. Alloy 1 in FIG. 2 refers to the curve generated for a preferred alloy of the present invention, $Fe_{80.5}Co_{0.5}B_{13.5}Si_{3.5}C_2$. Alloy 2 in FIG. 2 refers to the curve generated for a commercially available, alloy, $Fe_{78}B_{13}Si_9$. Alloy 3 in FIG. 2 refers to the curve generated for another commercially available, alloy $Fe_{81}B_{13.5}Si_{3.5}C_2$. The samples were prepared in accordance with the process described in Example 1. Toroidal test samples were prepared by wrapping approximately 15.4 kg of 10 cm wide alloy ribbon of each of the above recited compositions on a steel mandrel to produce a core having inside and outside diameters of 17.5 cm and 24.8 cm, respectively. Forty turns of high temperature magnetic wire were wound on the toroids to provide a D.C. circumferential field of 10 oersteds for annealing purposes.

Figure 3A:
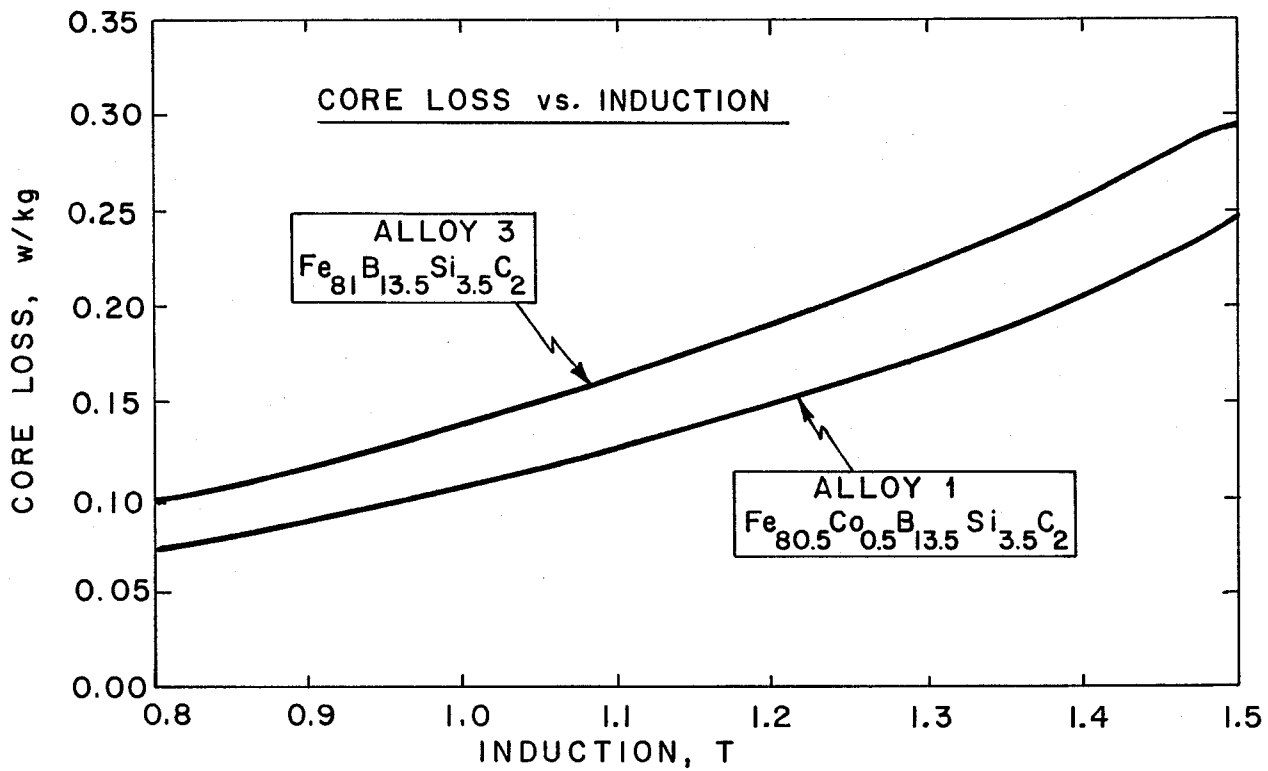
FIGS. 3*a* and 3*b* graphically compare core loss and exciting power, respectively, at different induction values of samples of a prior art alloy, $Fe_{81}B_{13.5}Si_{3.5}C_2$, and an alloy of the present invention, $Fe_{80.5}Co_{0.5}B_{13.5}Si_{3.5}C_2$.
Figure 3B:
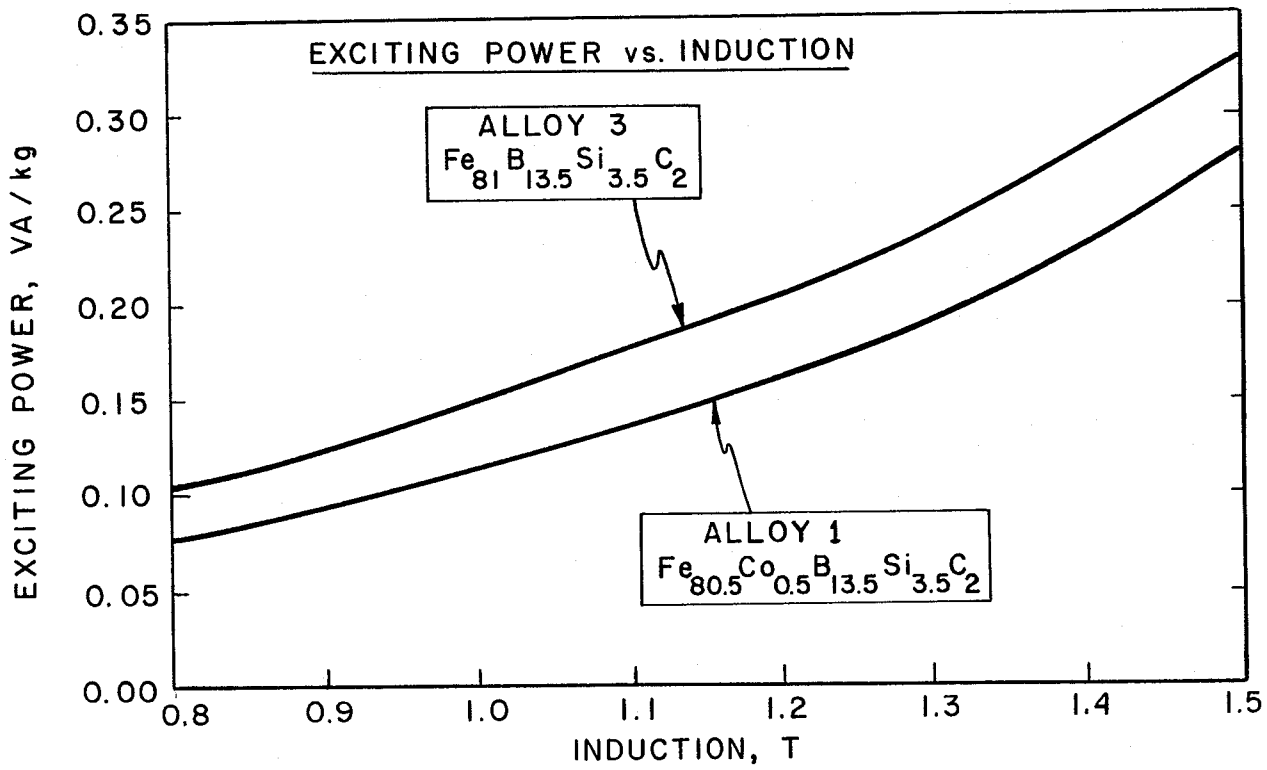

The sample of Alloy 2 was annealed in a nitrogen atmosphere for two hours at 360° C., with the field applied during heating and cooling. The Alloy 1 and Alloy 3 samples were annealed in a nitrogen atmosphere for two hours at 355° C., with the field being applied during heating and cooling. Each sample was cooled at a quenching rate of about 12° C./min. to 200° C. and then allowed to cool to room temperature. The saturation magnetization values were determined over a temperature range of −40° to 150° C. A plot of saturation induction values vs. temperature quite clearly illustrates substantially higher saturation values for Alloy 1 as compared to Alloy 2 at constant temperature, and comparable saturation values with those of Alloy 3. However, as clearly shown in FIGS. 3*a* and 3*b*, the average core loss for cores of Alloy 1 are considerably lower than the average core loss and exciting power attainable for cores from Alloy 3. Thus, it is readily apparent that cores of amorphous alloys of the present invention operated at a given induction level are, as compared to cores formed from prior art materials, substantially more efficient. Similarly, as illustrated in FIG. 4, cores formed from Alloy 1 of the present invention exhibit average core losses significantly lower than those achievable from cores formed of Alloy 2.

EXAMPLE 3

Figure 5A:
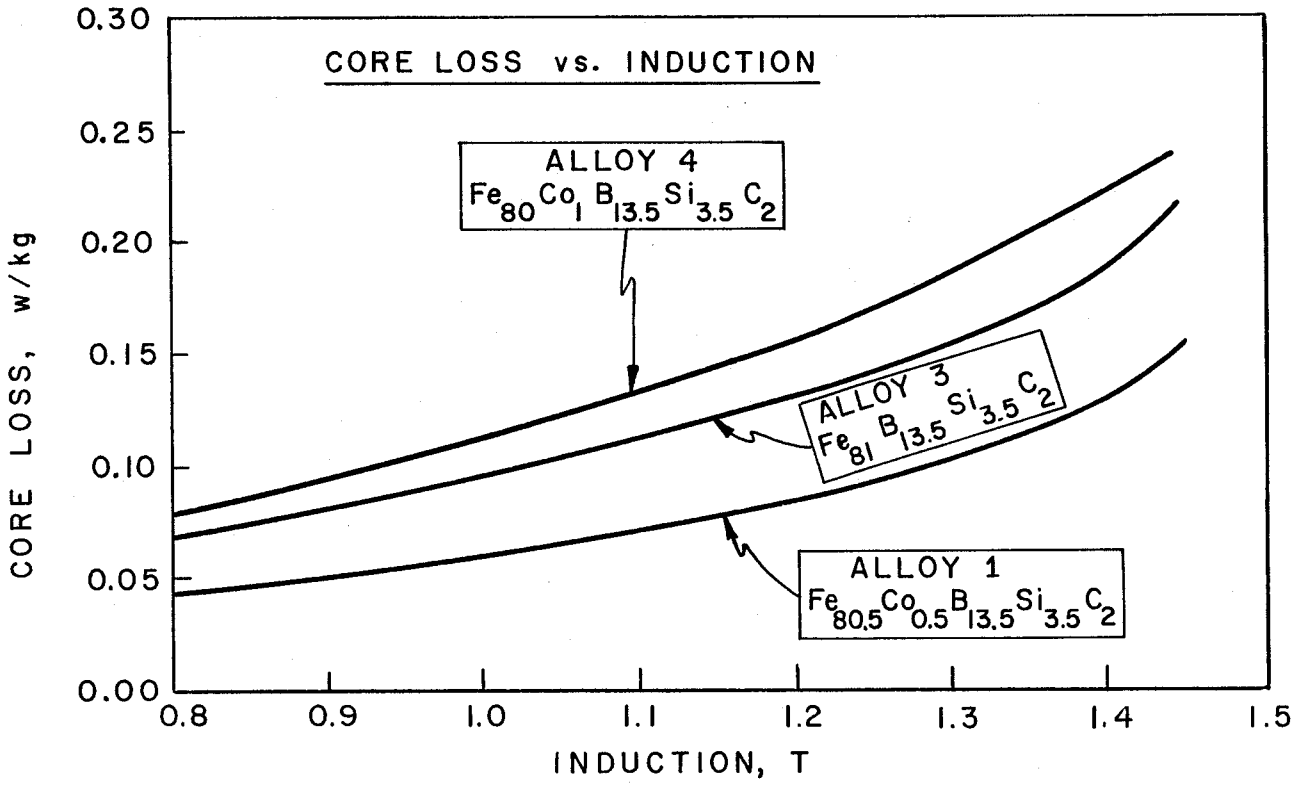
FIGS. 5*a* and 5*b* graphically illustrate the core loss and exciting power values, respectively, at different induction values of for each of a prior art alloy, $Fe_{81}B_{13.5}Si_{3.5}C_2$, a preferred alloy of the present invention, $Fe_{80.5}Co_{0.5}B_{13.5}Si_{3.5}C_2$, and an alloy outside the scope of the present invention, $Fe_{80}Co_1B_{13.5}Si_{3.5}C_2$.
Figure 5B:
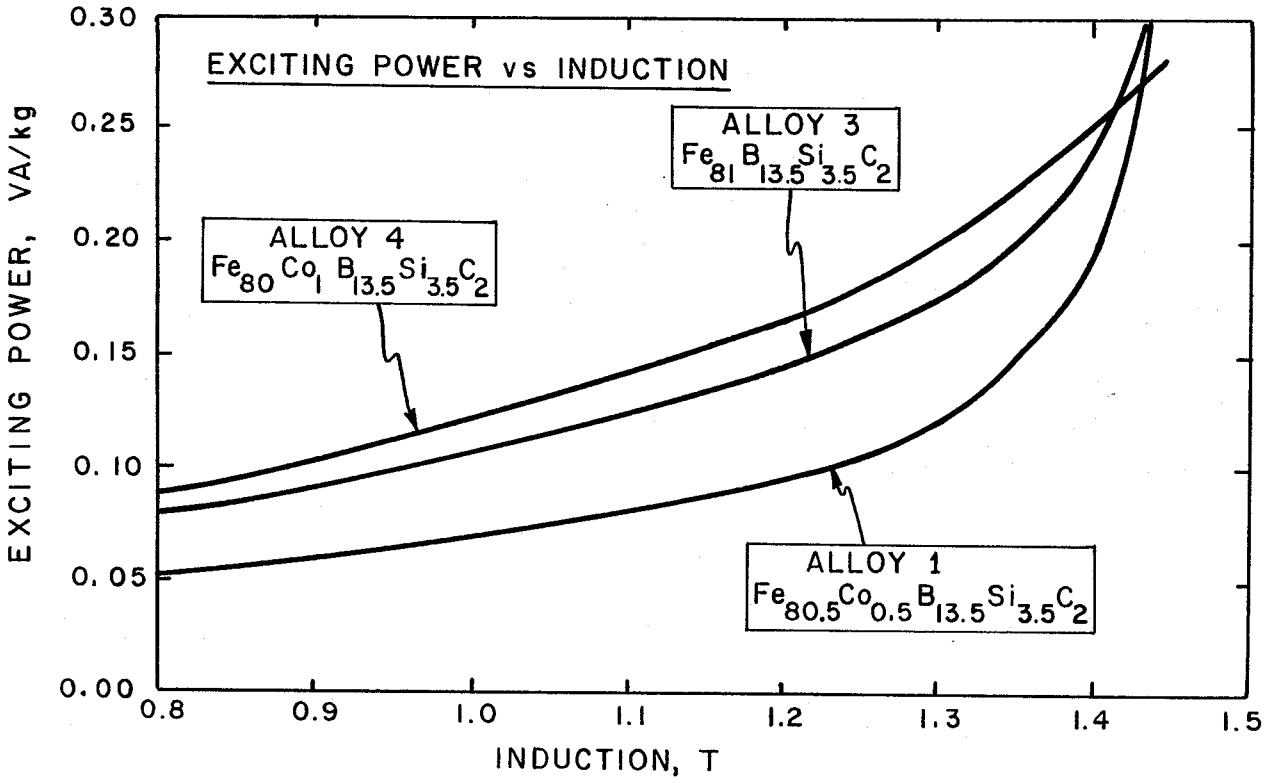

Toroidal cores were assembled from alloys having a nominal composition $Fe_{81-x}Co_xB_{13.5}Si_{3.5}C_2$, where x=0, 0.5 and 1.0. These toroids were then tested over a range of induction levels to develop magnetic loss vs. induction curves for each core sample. In FIGS. 5*a* and 5*b* curves for each of the alloys represent the results from cores formed from alloys with x=1, x=0.5, and x=0, respectively.

The alloys were produced by a process very similar to that described in Example 1.

The cores produced from the alloys for magnetic measurement were prepared by wrapping approximately 30 g of 5 cm wide alloy ribbon of each of the above recited compositions on a 4 cm diameter steatite mandrel. One hundred turns of high temperature magnet wire were wound on the toroidal cores to provide a D.C. circumferential field of 10 oersteds for annealing purposes. As is readily apparent from the curves in FIGS. 5*a* and 5*b*, cores formed from a preferred composition of the present invention (i.e., containing 0.5% Co) exhibit the lowest core loss and exciting power over normal operating induction levels. More generally, the results illustrate the criticality of the cobalt content (i.e., maintaining the content to between about 0.1–0.8) and its dramatic effect on the resultant core loss and exciting power values.

We claim:

1. A metallic alloy consisting essentially of a composition represented by the formula $$Fe_{a-b}Co_bB_cSi_dC_e$$

plus incidental impurities, wherein "a", "b", "c", "d" and "e" are atomic percentages ranging from about 75 to about 85, about 0.1 to about 0.8, about 12 to about 15, about 2 to about 5 and about 1 to about 3, respectively.

2. The metallic alloy of claim 1 wherein "a−b" is at least about 79.5.

3. The metallic alloy of claim 1 wherein "a−b" is about 80.5.

4. The alloy of claim 2 wherein "b" is between about 0.4 and about 0.6.

5. The alloy of claim 3 wherein "b" is about 0.5.

6. The alloy of claims 5 wherein "c" is about 13.5.

7. The alloy of claim 6 wherein "d" is about 3.5.

8. The alloy of claim 7 wherein "e" is about 2.

9. The alloy of claim 1 wherein the alloy is at least about 90% amorphous.

10. The alloy of claim 1 wherein the alloy is substantially entirely amorphous.

11. A metallic alloy which is at least about 90% amorphous consisting essentially of a composition represented by the formula:

$$Fe_{a-b}Co_bB_cSi_dC_e$$

plus incidental impurities, wherein "a", "b", "c", "d" and "e" are atomic percentages ranging from about 75 to about 85, about 0.1 to about 0.8, about 12 to about 15, about 2 to about 5 and about 1 to about 3, respectively, said alloy having a saturation induction of at least about 1.5 tesla over a temperature range of from about 0° C. to about 100° C.

12. A magnetic core composed of a body of metallic alloy which is at least about 90% amorphous, said alloy consisting essentailly of a composition represented by the formula:

$$Fe_{a-b}Co_bB_cSi_dC_e$$

plus incidental impurities, wherein wherein "a", "b", "c", "d" and "e" are atomic percentages ranging from about 75 to about 85, about 0.1 to about 0.8, about 12 to about 15, about 2 to about 5 and about 1 to about 3, respectively.

13. The magnetic core of claim 12 wherein the core losses do not exceed about 0.2 watts per kilogram at an induction of 1.3 tesla over a range of temperatures of from about −40° C. to about +150° C.

14. The magnetic core of claim 13 wherein the existing power requirements do not exceed about 0.3 volt-amperes per kilogram at induction levels of up to about 1.5 tesla.

* * * * *